US007093441B2

(12) United States Patent
Burd et al.

(10) Patent No.: US 7,093,441 B2
(45) Date of Patent: Aug. 22, 2006

(54) GAS TURBINE ANNULAR COMBUSTOR HAVING A FIRST CONVERGING VOLUME AND A SECOND CONVERGING VOLUME, CONVERGING LESS GRADUALLY THAN THE FIRST CONVERGING VOLUME

(75) Inventors: Steven W. Burd, Cheshire, CT (US); Albert K. Cheung, East Hampton, CT (US); John T. Ols, Coventry, CT (US); Reid D. Smith, Amston, CT (US); Irving Segalman, Boynton Beach, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/684,335

(22) Filed: Oct. 9, 2003

(65) Prior Publication Data

US 2006/0037322 A1 Feb. 23, 2006

(51) Int. Cl.
*F02G 3/00* (2006.01)
*F02C 1/00* (2006.01)

(52) U.S. Cl. ..... 60/752; 60/772; 60/754

(58) Field of Classification Search ..... 60/752–760, 60/737, 748, 732, 776, 772
See application file for complete search history.

(56) References Cited

U.S. PATENT DOCUMENTS

| | | | | | |
|---|---|---|---|---|---|
| 2,268,464 | A | * | 12/1941 | Seippel | 432/223 |
| 2,575,889 | A | * | 11/1951 | Oulianoff | 60/748 |
| 2,658,339 | A | * | 11/1953 | Bonsall | 60/752 |
| 3,872,664 | A | * | 3/1975 | Lohmann et al. | 60/746 |
| 4,265,615 | A | * | 5/1981 | Lohmann et al. | 431/353 |
| 4,420,929 | A | | 12/1983 | Jorgensen et al. | |
| 4,787,208 | A | | 11/1988 | DeCorso | |
| 4,819,438 | A | * | 4/1989 | Schultz | 60/730 |
| 5,129,231 | A | * | 7/1992 | Becker et al. | 60/754 |
| 5,239,818 | A | * | 8/1993 | Stickles et al. | 60/804 |
| 5,253,474 | A | | 10/1993 | Correa et al. | |
| 5,285,631 | A | | 2/1994 | Bechtel, II et al. | |
| 5,392,596 | A | * | 2/1995 | Holsapple et al. | 60/800 |
| 5,435,139 | A | | 7/1995 | Pidcock et al. | |
| 5,469,700 | A | * | 11/1995 | Corbett et al. | 60/776 |
| 5,592,819 | A | | 1/1997 | Ansart et al. | |
| 5,628,192 | A | * | 5/1997 | Hayes-Bradley et al. | 60/733 |
| 5,640,851 | A | * | 6/1997 | Toon et al. | 60/737 |
| 5,657,632 | A | * | 8/1997 | Foss | 60/742 |
| 5,758,503 | A | | 6/1998 | DuBell et al. | |
| 5,782,294 | A | | 7/1998 | Froemming et al. | |
| 5,797,267 | A | * | 8/1998 | Richards | 60/737 |
| 5,983,642 | A | * | 11/1999 | Parker et al. | 60/737 |
| 6,006,861 | A | * | 12/1999 | Clinton | 182/97 |
| 6,047,539 | A | * | 4/2000 | Farmer | 60/775 |
| 6,047,552 | A | * | 4/2000 | Gross et al. | 60/752 |

(Continued)

FOREIGN PATENT DOCUMENTS

GB 818634 8/1959

*Primary Examiner*—William H. Rodriguez
(74) *Attorney, Agent, or Firm*—Bachman & LaPointe, P.C.

(57) ABSTRACT

A gas turbine engine combustor has inboard and outboard walls. A forward bulkhead extends between the walls and cooperates therewith to define a combustor interior volume. In longitudinal section, a first portion of the combustor interior volume converges from fore to aft and a second portion, aft of the first portion converges from fore to aft more gradually than the first portion.

20 Claims, 3 Drawing Sheets

U.S. PATENT DOCUMENTS 6,182,451 B1 * 2/2001 Hadder ..... 60/732
6,189,814 B1 * 2/2001 Richards ..... 239/434
6,240,731 B1 6/2001 Hoke et al.
6,405,523 B1 * 6/2002 Foust et al. ..... 60/776
6,412,272 B1 * 7/2002 Titterton et al. ..... 60/39.37
6,438,958 B1 * 8/2002 McCaffrey et al. ..... 60/752
6,442,940 B1 * 9/2002 Young et al. ..... 60/748
6,449,952 B1 * 9/2002 Emilianowicz et al. ..... 60/772
6,470,685 B1 10/2002 Pidcock et al.
6,543,233 B1 * 4/2003 Young et al. ..... 60/752
6,651,437 B1 * 11/2003 Farmer et al. ..... 60/752
6,668,559 B1 * 12/2003 Calvez et al. ..... 60/796
6,735,950 B1 * 5/2004 Howell et al. ..... 60/748
6,751,961 B1 * 6/2004 Pacheco-Tougas et al. ... 60/752
6,810,673 B1 * 11/2004 Snyder ..... 60/752
2002/0116929 A1 * 8/2002 Snyder ..... 60/740
2002/0148228 A1 10/2002 Kraft et al.
2003/0213249 A1 * 11/2003 Pacheco-Tougas et al. ... 60/752
2003/0213250 A1 * 11/2003 Pacheco-Tougas et al. ... 60/752
2004/0006995 A1 * 1/2004 Snyder ..... 60/796
2004/0231333 A1 * 11/2004 Tiemann ..... 60/730
2005/0086940 A1 * 4/2005 Coughlan ..... 60/752
2005/0086944 A1 * 4/2005 Cowan ..... 60/776

* cited by examiner

GAS TURBINE ANNULAR COMBUSTOR HAVING A FIRST CONVERGING VOLUME AND A SECOND CONVERGING VOLUME, CONVERGING LESS GRADUALLY THAN THE FIRST CONVERGING VOLUME

BACKGROUND OF THE INVENTION (1) Field of the Invention

This invention relates to combustors, and more particularly to combustors for gas turbine engines.

(2) Description of the Related Art

Gas turbine engine combustors may take several forms. An exemplary class of combustors features an annular combustion chamber having forward/upstream inlets for fuel and air and aft/downstream outlet for directing combustion products to the turbine section of the engine. An exemplary combustor features inboard and outboard walls extending aft from a forward bulkhead in which swirlers are mounted and through which fuel nozzles/injectors are accommodated for the introduction of inlet air and fuel. Exemplary walls are double structured, having an interior heat shield and an exterior shell. The heat shield may be formed in segments, for example, with each wall featuring an array of segments two or three segments longitudinally and 8–12 segments circumferentially. To cool the heat shield segments, air is introduced through apertures in the segments from exterior to interior. The apertures may be angled with respect to longitudinal and circumferential directions to produce film cooling along the interior surface with additional desired dynamic properties. This cooling air may be introduced through a space between the heat shield panel and the shell and, in turn, may be introduced to that space through apertures in the shell. Exemplary heat shield constructions are shown in U.S. Pat. Nos. 5,435,139 and 5,758,503. Exemplary film cooling panel apertures are shown in U.S. Patent Application Publication 2002/0116929A1 and Ser. No. 10/147,571, the disclosures of which are incorporated by reference as if set forth at length.

Exemplary combustors are operated in a rich-quench-lean (RQL) mode. In an exemplary RQL combustor, a portion of the fuel-air mixing and combustion occurs in an upstream portion of the combustor in which the fuel-air mixture is rich (i.e., the spatial average composition is greater than stoichiometric). In this portion of the combustor, the fuel from the nozzles mix with air from the swirlers and participative cooling air in the fore portion of the combustor. In an intermediate quench portion, additional air flow ("process air") is introduced through orifices in the combustor walls to further mix with the fuel-air mixture and, over a short axial distance, transition the mixture to lean (i.e., less than stoichiometric) on a spatially averaged basis. This is often termed quenching of the reaction as, given typical fuel-air ratios, most of the energy in the fuel has been converted by reacting. In a downstream region, the mixture is lean and diluted to the design point overall fuel-air ratio as participative cooling further dilutes the mixture. An exemplary RQL combustor is shown in the aforementioned U.S. '929 publication.

SUMMARY OF THE INVENTION

One aspect of the invention involves a gas turbine engine combustor having inboard and outboard walls. A forward bulkhead extends between the walls and cooperates therewith to define a combustor interior volume. In longitudinal section, a first portion of the combustor interior volume converges from fore to aft and a second portion, aft of the first portion converges from fore to aft more gradually than the first portion.

In various implementations, the first portion may represent at least 25% of the interior volume and the second portion may represent at least 35% of the interior volume. The first portion may represent at least 35% of the interior volume and the second portion may represent at least 50% of the interior volume. The first and second portions, in combination, may represent at least 80 or 90% of the interior volume. The inboard wall may have a second portion aft of a first portion and at a longitudinal interior angle thereto of between 180° and 210°. The outboard wall may have a second portion aft of a first portion and at a longitudinal interior angle thereto of between 180° and 210°. These angles may be between 185° and 205°. The walls may each have an exterior shell and an interior multi-panel heat shield. In longitudinal section, the inboard and outboard walls may consist essentially of a number of straight sections.

The details of one or more embodiments of the invention are set forth in the accompanying drawing and the description and claims below.

BRIEF DESCRIPTION OF THE DRAWING

Like reference numbers and designations in the various drawings indicate like elements.

DETAILED DESCRIPTION

Figure 1:
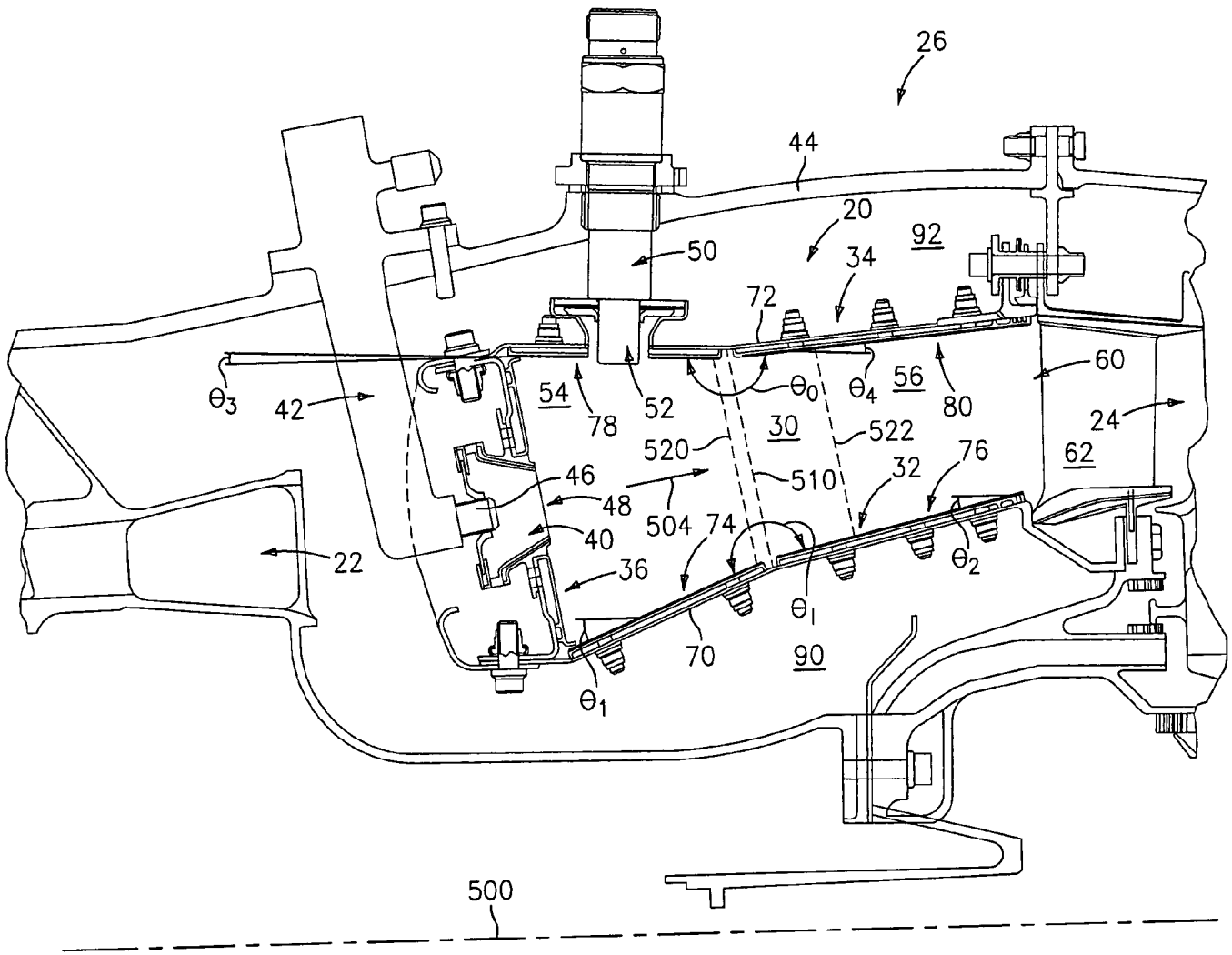
FIG. 1 is a longitudinal sectional view of a gas turbine engine combustor.

FIG. 1 shows an exemplary combustor 20 positioned between compressor and turbine sections 22 and 24 of a gas turbine engine 26 having a central longitudinal axis or centerline 500. The exemplary combustor includes an annular combustion chamber 30 surrounding the centerline 500 and bounded by inner (inboard) and outer (outboard) walls 32 and 34 and a forward bulkhead 36 spanning between the walls. The bulkhead carries a circumferential array of swirlers 40 and associated fuel injectors 42. The exemplary fuel injectors extend through the engine diffuser case 44 to convey fuel from an external source to the associated injector outlet 46 at the associated swirler 40. The swirler outlet 48 thus serves as a principal fuel/air inlet to the combustor. One or more sparkplugs 50 are positioned with their working ends 52 along an upstream portion 54 of the combustion chamber 30 to initiate combustion of the fuel/air mixture. The combusting mixture is driven downstream within the combustor along a principal flowpath 504 through a downstream portion 56 to a combustor outlet 60 immediately ahead of a turbine fixed vane stage 62.

The exemplary walls 32 and 34 are double structured, having respective outer shells 70 and 72 and inner heat shields. The exemplary heat shields are formed as multiple circumferential arrays (rings) of panels (e.g., inboard fore and aft panels 74 and 76 and outboard fore and aft panels 78 and 80). Exemplary panel and shell material are high temperature or refractory metal superalloys, optionally coated for thermal/environmental performance. Alternate materials include ceramics and ceramic matrix composites. Various known or other materials and manufacturing techniques may be utilized. In known fashion or otherwise, the panels may be secured to the associated shells such as by means of threaded studs integrally formed with the panels and supporting major portions of the panels with their exterior surfaces facing and spaced apart from the interior surface of the associated shell. The exemplary shells and panels are foraminate, with holes (not shown) (e.g., as in U.S. patent application Ser. No. 10/147,571) passing cooling air from annular chambers 90 and 92 respectively inboard and outboard of the walls 32 and 34 into the combustion chamber 30. The exemplary panels may be configured so that the intact portions of their inboard surfaces are substantially frustoconical. Viewed in longitudinal section, these surfaces appear as straight lines at associated angles to the axis 500. In the exemplary embodiment, the interior surface panel of inboard fore 74 is aftward/downstream diverging relative to the axis 500 at an angle $\theta_1$. The interior surface of the inboard aft panel 76 is similarly diverging at a lesser angle $\theta_2$. The interior surface of the fore outboard panel 78 is aft/downstream converging at a very small angle $\theta_3$. The interior surface of the aft outboard panel 80 is aftward/downstream diverging at an angle $\theta_4$. In the exemplary embodiment, the angles $\theta_1$ and $\theta_3$ are such that the cross-section of the chamber upstream portion 54 is aftward/downstream converging along the central flowpath both in terms of linear sectional dimension and annular cross sectional area. The chamber downstream portion 56 is similarly convergent, although at a much smaller rate. The converging upstream portion serves to induce higher bulk velocities and reduce residence time at rich conditions. The convergence also promotes a small separation between inner and outer walls in the central region of the combustor. The small separation facilitates effective introduction of process air. The process air for mixing with the fuel-air mixture from the primary zone may be introduced in the vicinity of the transition between upstream and downstream portions 54 and 56 or in the downstream lean zone. Additionally, by keeping the combustor outer wall relatively close to the engine centerline, heat shield surface area and mass may be reduced relative to other combustor configurations. This reduction serves to limit the amount of cooling required and thus the amount of cooling air required. The air which otherwise would be required for cooling may, alternatively, then be introduced upstream (e.g., at the swirler) so as to participate in the combustion process to achieve a desired combustion profile and emissions performance. Air which might otherwise be used for film cooling can also be delivered downstream of the swirler (e.g., via the process air holes) to achieve a desired combustion profile. In the exemplary embodiment, the longitudinal interior (within the combustion chamber 30) angle between the interior surfaces of the inboard wall panels is shown as $\theta_1$ and that of the outboard wall panels is shown as $\theta_O$. In the exemplary embodiment, both these angles are somewhat greater than 180°. In the exemplary embodiment, the junctions between fore and aft panels substantially define a dividing area 510 between fore and aft combustion chamber portions 54 and 56. An exemplary range of $\theta_1$ and $\theta_O$ are 180°–210°. A tighter lower bound is 185° and tighter upper bounds are 200° and 205°.

The combustor may be operated in an RQL mode. A given optimization of parameters may seek to balance results in terms of capacity, efficiency, output parameters (e.g., temperature distribution), and, notably, emissions control based upon factors including the dimensions and the identified angles as well as the amount and distribution of air introduced through the swirlers and panels. In exemplary implementations, the largest portion of air flow through the combustor will be process air introduced through the panels, typically a majority (e.g., 40–70%). Coolant air (e.g., film cooling air passing through the heat shield panels) may be the next largest amount (e.g., 15–35%) with the remainder being introduced along with the fuel at the swirler. These conditions/proportions, as well as the combustion profile/performance will vary about such ranges based upon the operating condition of the engine. For example, at relatively low power operating conditions, a very high proportion of the combustion (e.g., in the vicinity of 95%) will occur in the rich primary and quench zones, with a significant portion upstream of the dividing area 510. At a higher-power condition, this amount may be less, approximately evenly split between rich and lean zones. By way of example, an annular boundary 520 slightly upstream of the dividing area 510 shows the approximate boundary between rich and transition regions, with the exemplary process dilution air being introduced through a circular array of relatively large coaligned apertures in the heat shield panels and shells near the upstream (leading) edges of the downstream heat shield panels. A downstream boundary 522 similarly separates the transition and lean zones. The locations of the boundaries 520 and 522 will depend upon the location and dimensions of the apertures and upon operating conditions.

Figure 2:
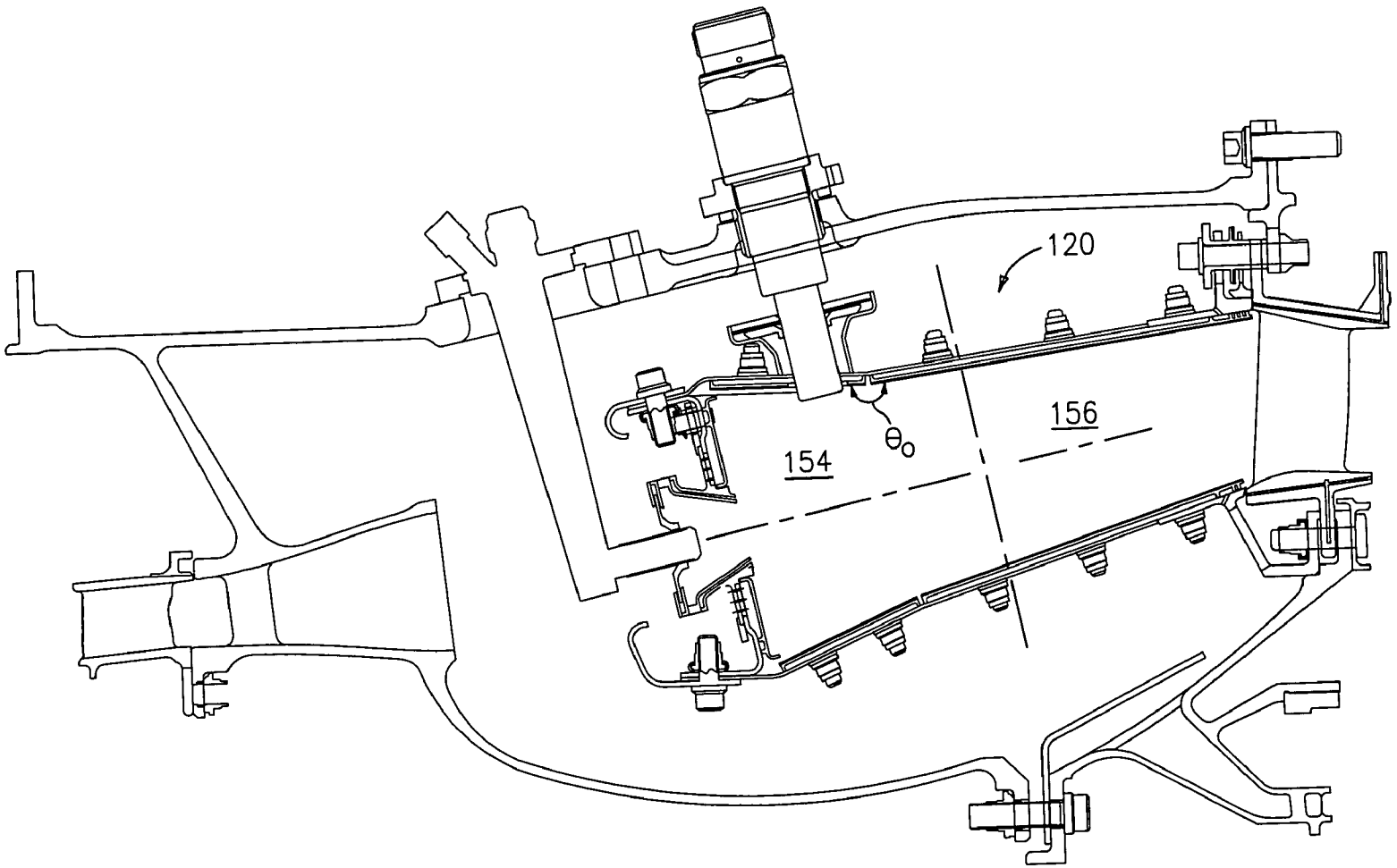
FIG. 2 is a longitudinal sectional view of a second gas turbine engine combustor.
Figure 3:
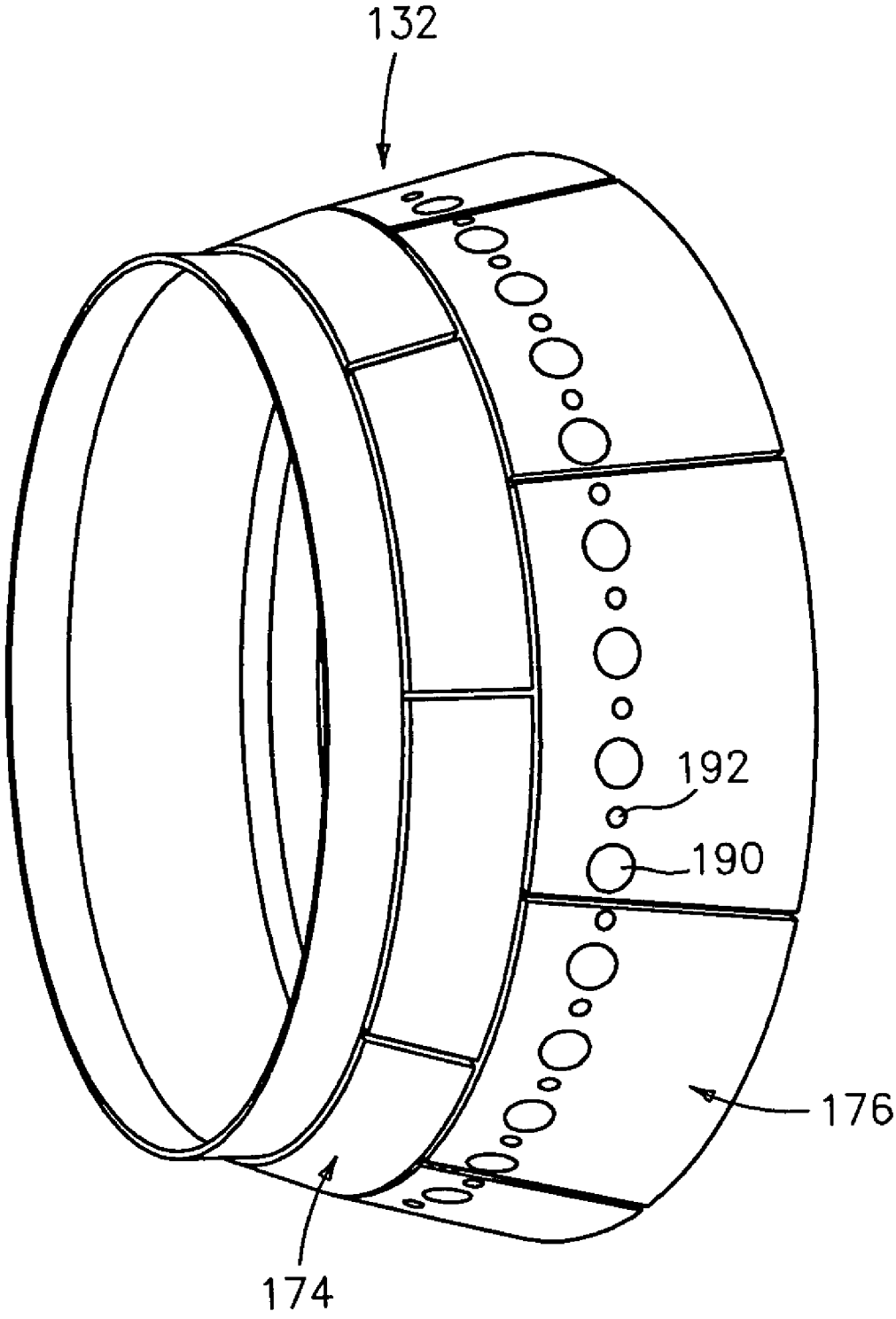
FIG. 3 is a view of an inboard wall of the second combustor of FIG. 2, with outer wall and bulkhead removed to permit viewing.

FIG. 2 shows an alternate combustor 120 which differs from the combustor 20 principally in that the walls and their associated panels are dimensioned so that the transition between upstream and downstream chamber portions 154 and 156 is located further upstream. The different arrangement may be dictated by the different envelope offered by the associated engine, including one or more factors of: diffuser geometry; relative position of compressor outlet/exit and turbine inlet; igniter position/orientation, and the like. Thus any particular embodiment may have a somewhat differing arrangement of primary, quench, and lean zone volumes and characteristics. FIG. 3 shows the fore and aft panels 174 and 176 of the inboard wall 132. Each aft panel 176 is shown as having a circumferential array of alternating large and small apertures 190 and 192 positioned relatively forward along such panel. These apertures provide for introduction of the process air to the combustion chamber. The respective large and small orifices of the inboard panels are exactly out of phase with those of the outboard panels. Accordingly, a large orifice of one panel will be circumferentially aligned with a small orifice of the other. This creates intermeshing air streams which further enhances mixing within the combustor.

One or more embodiments of the present invention have been described. Nevertheless, it will be understood that various modifications may be made without departing from the spirit and scope of the invention. For example, when applied as a reengineering of an existing combustor, details of the existing combustor will influence details of the particular implementation. Accordingly, other embodiments are within the scope of the following claims.

What is claimed is:

1. A gas turbine engine combustor comprising:

an inboard wall;

an outboard wall; and a forward bulkhead extending between the inboard and outboard walls and cooperating therewith to define a combustor interior volume, wherein, in longitudinal section, a first portion of the combustor interior volume converges from fore to aft and a second portion of the combustor interior volume, aft of the first portion, converges from fore to aft more gradually than the first portion.

2. The combustor of claim 1 wherein:

said first portion represents at least 25% of the interior volume; and said second portion represents at least 35% of the interior volume.

3. The combustor of claim 1 wherein:

said first portion represents at least 35% of the interior volume; and said second portion represents at least 50% of the interior volume.

4. The combustor of claim 1 wherein:

said first and second portions, in combination, represent at least 80% of the interior volume.

5. The combustor of claim 1 wherein:

said first and second portions, in combination, represent at least 90% of the interior volume.

6. The combustor of claim 1 wherein:

the inboard wall has a first portion and a second portion aft of the first portion and at a longitudinal interior angle to the first portion of the inboard wall of between 180° and 210°; and the outboard wall has a first portion and a second portion aft of the first portion and at a longitudinal interior angle to the first portion of the outboard wall of between 180° and 210°.

7. The combustor of claim 1 wherein the inboard and outboard walls each have an exterior shell and an interior multi-panel heat shield.

8. A gas turbine engine combustor comprising:

an inboard wall;

an outboard wall; and a forward bulkhead extending the inboard and outboard walks and cooperating therewith to define a combustor interior volume, wherein, at least one of the inboard wall and the outboard wall has a first portion and a second portion aft of the first portion, the second portion at a longitudinal interior angle to the first portion of between 185° and 210°.

9. The combustor of claim 8 wherein the other of the inboard wall and the outboard wall has a first portion and a second portion aft of the first portion of said other, the second portion of said other at a longitudinal interior angle to the first portion of said other of between 185° and 205°.

10. The combustor of claim 8 wherein in longitudinal section the inboard and outboard walls consist essentially of a plurality of straight sections.

11. A method for engineering a gas turbine engine combustor having an inboard wall, an outboard wall, and a forward bulkhead extending the inboard and outboard walls and cooperating therewith to define a combustor interior volume, wherein, in longitudinal section, a first portion of the combustor interior volume converges from fore to aft and a second portion of the combustor interior volume, aft of the first portion, converges from fore to aft more gradually than the first portion, the method comprising:

selecting a degree of convergence of the first portion so as to provide a desired low first portion residence time; and selecting a degree of convergence of the second portion in combination with selecting introduction parameters for process air so as to provide a desired low generation of $NO_x$.

12. The method of claim 11 wherein the selection of said degrees of convergence and parameters of introduction for process air are varied to provide a desired short quench zone.

13. The method of claim 11 wherein the engineering serves to reduce said generation of $NO_x$ relative to a baseline combustor being reengineered or replaced.

14. The method of claim 11 wherein the combustion interior volume is annular.

15. The method of claim 11 wherein the combustion interior volume surrounds an engine centerline.

16. The combustor of claim 8 wherein the combustion interior volume is annular.

17. The combustor of claim 8 wherein the combustion interior volume surrounds an engine centerline.

18. The combustor of claim 1 wherein the combustion interior volume surrounds an engine centerline.

19. A gas turbine engine combustor comprising:

an inboard wall;

an outboard wall; and a forward bulkhead extending between the inboard and outboard walls and cooperating therewith to define an annular combustor interior volume, wherein, in longitudinal section, a first portion of the combustor interior volume converges from fore to aft and a second portion of the combustor interior volume, aft of the first portion, converges from fore to aft more gradually than the first portion.

20. The combustor of claim 19 wherein the combustion interior volume surrounds an engine centerline.

* * * * *

UNITED STATES PATENT AND TRADEMARK OFFICE

CERTIFICATE OF CORRECTION

PATENT NO. : 7,093,441 B2
APPLICATION NO. : 10/684335
DATED : August 22, 2006
INVENTOR(S) : Steven W. Burd et al.

It is certified that error appears in the above-identified patent and that said Letters Patent is hereby corrected as shown below:

In column 5, claim 8, line 36, “walks” should read --walls--.

Signed and Sealed this

Tenth Day of April, 2007

JON W. DUDAS
*Director of the United States Patent and Trademark Office*